US007096952B2

(12) United States Patent
Harmon et al.

(10) Patent No.: US 7,096,952 B2
(45) **Date of Patent: *Aug. 29, 2006**

(54) LATCH MECHANISM GUIDE

(75) Inventors: Stephen K. Harmon, Houston, TX (US); Mark D. Kuck, Anchorage, AK (US); Roy E. Swanson, Sugarland, TX (US); Francine A. Bradford, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 163 days.

This patent is subject to a terminal disclaimer.

(21) Appl. No.: 10/823,384

(22) Filed: Apr. 12, 2004

(65) Prior Publication Data

US 2004/0262005 A1 Dec. 30, 2004

Related U.S. Application Data

(63) Continuation-in-part of application No. 10/260,211, filed on Sep. 26, 2002, now Pat. No. 6,719,052.

(51) Int. Cl.
*E21B 31/18* (2006.01)

(52) U.S. Cl. ..... 166/301; 166/98; 166/99; 294/86.15; 294/86.26

(58) Field of Classification Search ..... 166/301, 166/98, 99; 294/86.15, 86.26, 86.29, 86.31
See application file for complete search history.

(56) References Cited

U.S. PATENT DOCUMENTS

| | | | |
|---|---|---|---|
| 750,491 | A | 1/1904 | Sargert |
| 1,337,476 | A | 4/1920 | Kliewer |
| 1,749,869 | A | 3/1930 | Baumbach |
| 1,795,322 | A | 3/1931 | Triplett |
| 2,207,649 | A | 7/1940 | Williams et al. |
| 2,236,761 | A | 4/1941 | Nichols |
| 2,250,440 | A | 7/1941 | Shannon |
| 2,709,617 | A | 5/1955 | Lang |
| 3,074,486 | A | 1/1963 | Murray, Jr. |
| 3,152,829 | A | 10/1964 | Steele |
| 3,199,906 | A | 8/1965 | Chenoweth |
| 3,570,598 | A | 3/1971 | Johnson |
| 3,628,822 | A | 12/1971 | Bostock |
| 3,785,690 | A | 1/1974 | Hutchinson |
| 3,863,974 | A | 2/1975 | Dinning |
| 3,930,679 | A | 1/1976 | Anderson et al. |
| 4,030,745 | A | 6/1977 | Schoeffler et al. |
| 4,368,911 | A | 1/1983 | Pringle |
| 4,756,364 | A | 7/1988 | Christensen et al. |
| 4,883,120 | A | 11/1989 | Schasteen et al. |
| 5,106,140 | A | 4/1992 | Knotts |
| 5,361,844 | A | 11/1994 | Taylor et al. |
| 5,580,114 | A | 12/1996 | Palmer |

(Continued)

OTHER PUBLICATIONS

Baker Hughes brochure; *Hydraulic Snipper Overshot*; Mar. 17, 2000; one page.

(Continued)

*Primary Examiner*—Hoang Dang
(74) *Attorney, Agent, or Firm*—Gerald W. Spinks

(57) ABSTRACT

An apparatus and method for guiding a fish into engagement with a latch mechanism on a fishing tool, by expanding the ends of a set of fingers into contact with a bore hole. The ends of the fingers surround the fish and guide the fish and the latch mechanism together, as the tool is lowered, until the latch mechanism latches onto the fish.

16 Claims, 3 Drawing Sheets

U.S. PATENT DOCUMENTS

| | | | | |
|---|---|---|---|---|
| 6,095,583 | A | 8/2000 | Beeman et al. | |
| 6,196,309 | B1 | 3/2001 | Estilette | |
| 6,848,507 | B1 * | 2/2005 | Huggins et al. | 166/301 |

OTHER PUBLICATIONS

Baker Hughes brochure; *Thru-Tubing Fishing Hydraulic Release Overshot*; Sep. 7, 2000; one page.

Baker Hughes brochure; *Thru-Tubing Hydraulic Release "GS" Spear*; Mar. 12, 2002; one page.

Baker Hughes brochure; *TTF Snipper Overshot*; May 7, 2002; one page.

Bowen manual cover; *Full Circle Releasing Spears*; date unknown; one page.

Bowen manual cover; *Short Catch Overshots*; date unknown; one page.

Houston Engineers catalog: *HE Style "G" Releasing and Circulating Overshot*; Drilling and Fishing Tools; Mar. 1997; three pages.

* cited by examiner

LATCH MECHANISM GUIDE

CROSS REFERENCE TO RELATED APPLICATIONS

This is a continuation-in-part patent application of U.S. patent application Ser. No. 10/260,211, filed on Sep. 26, 2002, now U.S. Pat. No. 6,719,052 and entitled "Latch Mechanism Guide."

STATEMENT REGARDING FEDERALLY SPONSORED RESEARCH OR DEVELOPMENT

Not Applicable

BACKGROUND OF THE INVENTION

1. Field of the Invention

The present invention is in the field of tools used to retrieve lodged or stuck items, called fish, from a well bore or casing.

2. Background Art

In the art of well drilling and workover, it is common to have a need to retrieve a stuck tool or other item from the well bore or casing. For the purposes of describing the invention herein, the terms casing and bore hole should be understood to mean any well bore, casing, or other tubing within which items may be lodged or stuck. Stuck items are commonly called fish. The fish may be a broken tool which has inadvertently stuck in the casing, or it may be a tool such as a whipstock, which is intentionally installed in the casing, to be removed or fished out later. Some types of fish have specially designed fishing tools which are suitable for latching onto a fishing contour on the uphole end of the fish. Others may be retrievable with a more general purpose fishing tool which is designed to latch onto many different configurations of fish. One example is a latch mechanism made up of a collet and a central spear, in which the central spear assists the collet in latching onto the fish.

Regardless of whether the fish is to be retrieved with a specially designed fishing tool or with a general purpose fishing tool, it is necessary for the tool to align with the fish, to a greater or lesser degree, depending upon the particular fish and the particular fishing tool. In some cases, as the fishing tool is run into the hole, the latch mechanism may be generally aligned with the center of the casing or bore hole, and the upper end of the fish may be aligned to one side, or vice versa. Such misalignment can make it very difficult to latch onto the fish with the fishing tool.

The possibility for such misalignment is even more likely to occur when the fish lies in a highly deviated or horizontal hole. In such situations, the operator usually relies upon gravity to deflect the fishing tool toward the same side of the casing as the uphole end of the fish. However, where an inflation element or whipstock is lodged in a highly deviated bore hole or casing, the uphole end of the fish may be positioned in the center of the hole, or even near the upper side of the deviated hole. Where gravity deflects the latch mechanism of the fishing tool toward the lower side of the deviated hole, latching onto this type of fish may be impractical at best. Since the present invention addresses the alignment of fish and fishing tools in deviated holes as well as vertical holes, the terms uphole and downhole will generally be used herein, it being understood that these terms mean the same as the terms upper and lower, respectively, in a vertical hole.

The currently known fishing tool may have bow centralizers installed to position the latch mechanism, or bent subs may be used to orient the latch mechanism properly via a trial and error type operation. These methods can be less than satisfactory, and they can consume valuable time.

BRIEF SUMMARY OF THE INVENTION

The present invention provides a method and apparatus for guiding a latch mechanism and a fish into engagement, regardless of their relative positions in the bore hole or casing. The fishing tool is lowered downhole on a work string, until it is positioned just above a fish. The work string can be a wire line, where appropriate. In the running position, a plurality of guide fingers on the downhole end of the tool are retracted radially inwardly, minimizing the overall diameter of the tool. This can be accomplished with a sleeve at least partially surrounding the guide fingers, for example, contacting the outer edges or surfaces of the fingers to hold them radially inwardly. When the tool is just above the fish, a mechanical or hydraulic actuation mechanism shifts the sleeve longitudinally and expands the downhole ends of the guide fingers until the fingers contact the casing. The sleeve can have slots which contact radially extending tangs on the upper ends of the fingers to rotate the lower ends of the fingers radially outwardly.

In this expanded configuration, the guide fingers are arrayed in a basically frusto-conical array, with the base of the frusto-conical array downhole and the apex of the frusto-conical array uphole. A latch mechanism, such as a collet and spear assembly, is mounted on the fishing tool near the downhole end of the mandrel, and near the uphole ends of the guide fingers. Other types of latch mechanisms may also be used. The guide fingers are spaced as close together as possible to improve the guiding performance of the conical array, and minimize the likelihood of the uphole end of the fish passing between two guide fingers.

When the fingers are expanded, further lowering of the tool causes the conical array of expanded guide fingers to guide the uphole end of the fish and the latch mechanism into engagement with each other. More specifically, the combined inner surfaces of the guide fingers form a substantially conical guide cage for guiding the fish and the latch mechanism into engagement with each other. This may involve guiding the downhole end of the fishing tool toward the location of the uphole end of the fish, or vice versa, or a combination of both. After engagement of the fish with the latch mechanism, the fishing tool may be pulled uphole, retrieving the fish. During retrieval, the fingers can be retracted to some extent by shifting the sleeve relative to the mandrel, depending upon the type of latch mechanism used and upon the type of fish. Where a mechanically actuated guide mechanism is used, re-entry of the tool into a smaller tubular can reverse the action of the actuation mechanism, to shift the sleeve downwardly, thereby retracting the fingers.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
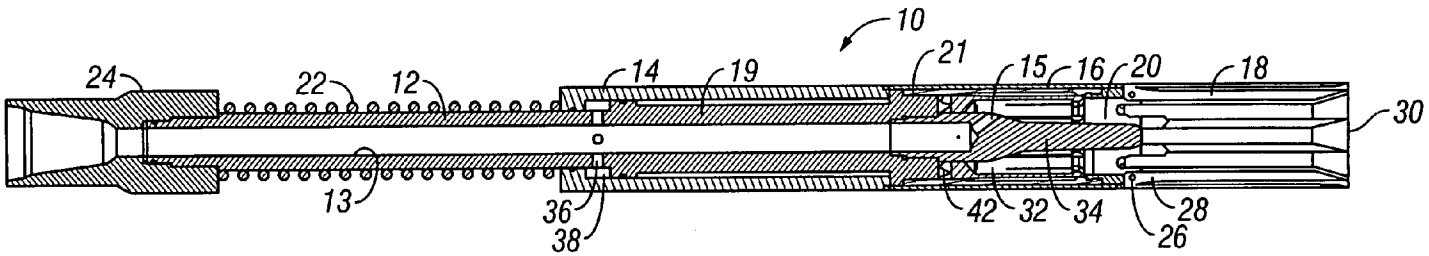
FIG. 1 is a longitudinal section view of a tool having a hydraulic actuation mechanism, in the running configuration.
Figure 2:
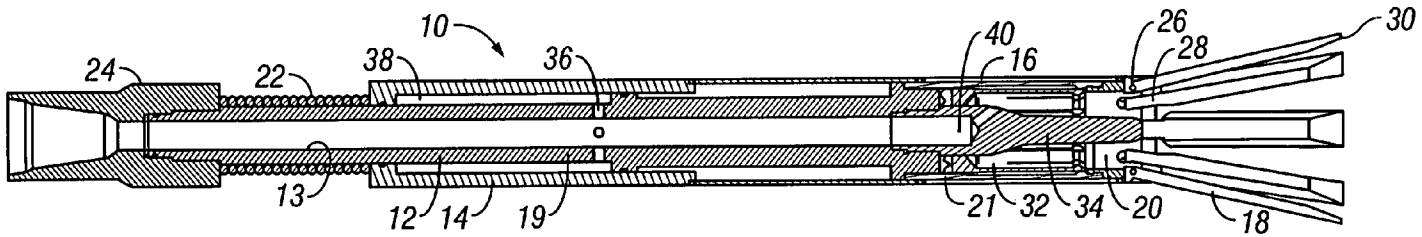
FIG. 2 is a longitudinal section view of the tool shown in FIG. 1, with the guide fingers in the expanded configuration.

As shown in FIGS. 1 and 2, the fishing tool 10 includes a mandrel assembly 12, a hollow piston 14 longitudinally movable relative to the mandrel assembly 12, a finger sleeve 16 fixedly attached to the piston 14, and a plurality of guide fingers 18 pivotably attached to the downhole end of the mandrel assembly 12. In FIG. 1, the piston 14 and the finger sleeve 16 are shown in their respective downhole positions relative to the mandrel assembly 12. In FIG. 2, the piston 14 and the finger sleeve 16 are shown in their respective uphole positions relative to the mandrel assembly 12. The mandrel assembly 12 includes a hollow elongated mandrel 19 and a hollow finger cage 20, joined together by a hollow mandrel skirt 21. The finger cage 20 is mounted to the downhole end of the mandrel skirt 21, which is attached at the downhole end of the mandrel 19, placing the finger cage 20 at the downhole end of the mandrel assembly 12. A spring 22, such as a coil spring, can bias the piston 14 longitudinally in the downhole direction relative to the mandrel assembly 12, by abutting a top sub 24 attached to the uphole end of the mandrel 19. The top sub 24 is adapted to attach to a work string (not shown), such as by being threaded thereto. Pivot points, which can include a plurality of pivot pins 26, are spaced annularly around the finger cage 20. The uphole ends 28 of the guide fingers 18 pivot about the pivot pins 26. The downhole ends 30 of the guide fingers 18 are free ends, as better seen in FIG. 2, in that they are not attached to another portion of the tool. A latch mechanism, such as a combination of a collet 32 and a spear 34, is mounted adjacent the downhole end of the mandrel assembly 12, above the finger cage 20, and within the mandrel skirt 21. Other types of latch mechanisms, such as a grapple or a spear, could be used instead of the collet and spear combination, depending upon the type of fish to be retrieved.

A longitudinal fluid bore 13 within the mandrel 19 and one or more main ports 15 through the spear 34 form a fluid passage provided to conduct pressurized fluid, from a pump (not shown) at the well site, through the tool 10 to the space below the lower end of the mandrel 19. The main ports 15 could alternatively be provided through other latch mechanisms or through the lower end of the mandrel 19 itself. The bore 13 and one or more actuation ports 36 through the wall of the mandrel 19 also form a fluid passage to conduct pressurized fluid into an annular space or chamber 38 between the mandrel 19 and the hollow piston 14. A tell-tale hole 40 can also be provided through the spear 34, or alternatively through the lower end of the mandrel 19, from the bore 13 to the space below the lower end of the mandrel 19. A spring such as a wave spring 42 can be provided in a space between the uphole end of the collet 32 and the downhole end of the mandrel 19, to force the collet 32 downwardly against the fluid backpressure, into abutment with the uphole end of the finger cage 20. This keeps the collet 32 longitudinally aligned with the tell-tale hole 40 regardless of increased fluid pressure, to block the tell-tale hole 40 until latching occurs, as described below.

Figure 3:
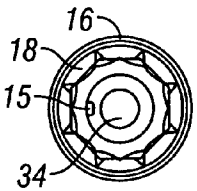
FIG. 3 is an elevation view of the downhole end of the running configuration of the tool shown in FIG. 1.

FIG. 1 shows the tool 10 in the running configuration, with the free downhole ends 30 of the guide fingers 18 pivoted radially inwardly to their retracted positions. In this configuration, the return spring 22 exerts sufficient force to hold the piston 14 and the finger sleeve 16 in their respective downhole positions against the backpressure of fluid in the annular space 38. It can be seen that the finger sleeve 16 contacts the outer edges or surfaces of the fingers 18 to hold their free downhole ends 30 inwardly. FIG. 3 shows an elevation view of the downhole end of the tool 10 in this running configuration. As shown here, the guide fingers 18 are configured to lie as closely together as possible, with their side edges abutting each other when the fingers 18 are in their fully retracted positions. This minimizes the diameter of the lower portion of the tool 10 in the running configuration, in which the tool 10 is run into the hole on the work string.

Figure 4:
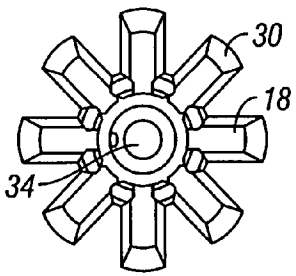
FIG. 4 is an elevation view of the downhole end of the expanded configuration of the tool shown in FIG. 2.

FIG. 2 shows the tool 10 with the free downhole ends 30 of its guide fingers 18 in their fully expanded positions. FIG. 4 shows an elevation view of the downhole end of the tool 10 in this expanded configuration. As shown here, the downhole ends 30 of the guide fingers 18 are expanded by a radial distance which is designed to contact the wall of a given diameter bore hole or casing, as seen better in FIG. 6. Since the fingers 18 are configured to lie as closely together as possible when the fingers 18 are in their fully retracted positions, the likelihood is minimized that the upper end of a fish can pass between the fingers 18 in this expanded configuration.

When the tool 10 has been lowered into the bore hole in the running configuration shown in FIGS. 1 and 3, to a position just above a fish, the tool 10 is shifted into its expanded configuration shown in FIGS. 2 and 4 through 7. To shift the tool 10 from the running configuration to the expanded configuration, fluid pressure in the mandrel bore 13 is increased until backpressure caused by flow of fluid through the main ports 15 rises to a sufficient level in the annular space 38 to overcome the force generated by the spring 22. When the backpressure reaches this level, it causes the piston 14 to shift longitudinally in the uphole direction relative to the mandrel 19, carrying with it the finger sleeve 16. This places both the piston 14 and the finger sleeve 16 in their respective uphole positions relative to the mandrel assembly 12.

Figure 5:
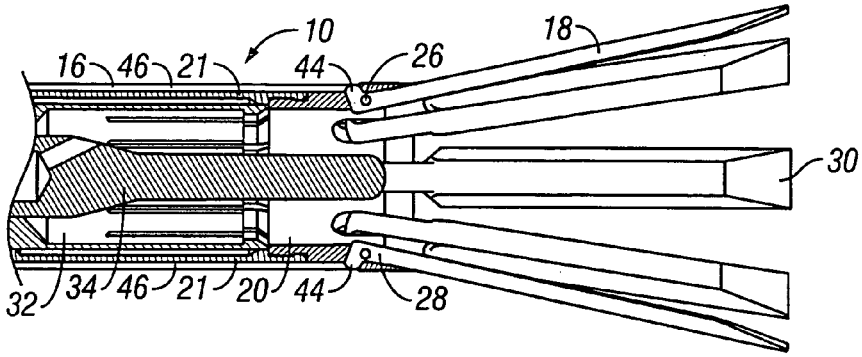
FIG. 5 is an enlarged section view of the downhole portion of the expanded configuration of the tool shown in FIG. 2.
Figure 6:
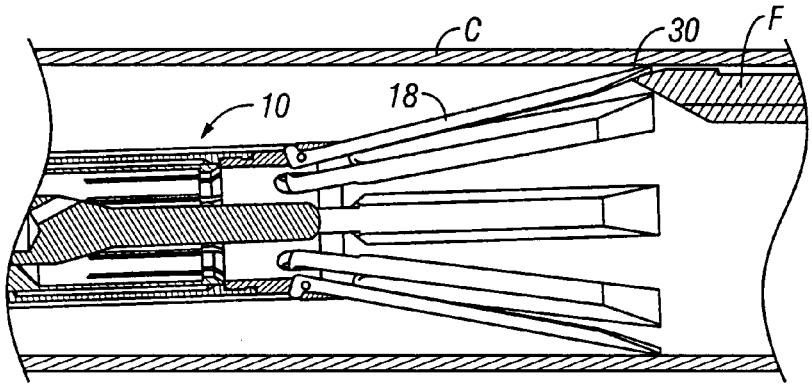
FIG. 6 is an enlarged section view of the expanded configuration of the tool shown in FIG. 5, engaging the uphole end of a fish in the casing.

As better seen in FIG. 5, the uphole end 28 of each guide finger 18 has a tang 44 which extends radially outwardly, above the pivot pin 26. Each finger tang 44 extends into a longitudinal slot 46 in the finger sleeve 16. When the piston 14 and the sleeve 16 are shifted in the uphole direction by hydraulic pressure, two things happen. One, the finger sleeve 16 shifts a sufficient distance so that it no longer surrounds the guide fingers 18, making it possible for the fingers 18 to pivot. Two, the lower ends of the finger sleeve slots 46 contact the finger tangs 44 and force them in the uphole direction relative to the finger cage 20. This forcibly pivots the fingers 18 and forcibly drives the downhole ends 30 of the fingers 18 radially outwardly until they contact the wall of a bore hole or casing C, as shown in FIG. 6.

The embodiment shown in FIGS. 1 and 2 has a hollow external piston 14 and an external finger sleeve 16. Alternatively, a solid piston and an internal finger sleeve could be used. That is, for instance, the finger sleeve could be positioned radially inwardly from the fingers 18, and the finger tangs 44 could extend radially inwardly. A solid piston could be driven in the downhole direction, for instance within the mandrel bore 13, shifting the finger sleeve downwardly to force the tangs 44 downwardly and pivot the fingers 18 outwardly. In such an embodiment, the upper ends of a set of similar but shorter sleeve slots could be appropriately positioned to contact the inwardly extending tangs 44 as the sleeve moves downwardly to force the tangs 44 downwardly and expand the fingers 18, while the lower ends of the sleeve slots could be positioned to contact the tangs 44 as the sleeve moves upwardly to push the tangs 44 upwardly and retract the fingers 18. Nevertheless, the expanded and retracted configurations of the fingers 18 would be the same as with the embodiment shown in FIGS. 1 and 2.

Figure 7:
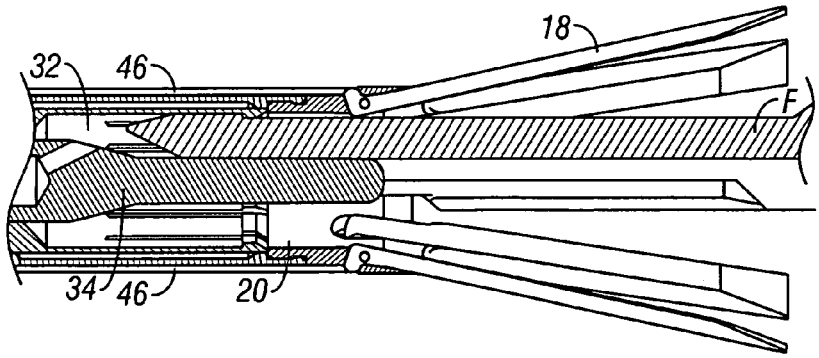
FIG. 7 is an enlarged section view of the expanded configuration of the tool shown in FIG. 6, with the uphole end of a fish guided into engagement with the latch mechanism.

Preferably, the inner or outer surfaces of the downhole ends 30 of the fingers 18 can be beveled, so that the downhole ends 30 of the fingers 18 present a low profile as they lie against the casing C. This provides a relatively thin wedge shape to wedge between the casing C and almost any shape of fish F that may be encountered, regardless of the positioning of the fish relative to the casing C. Alternatively, the downhole ends 30 of the fingers 18 could be shaped as appropriate to surround a particular fish that is to be removed. In any case, as shown in FIG. 6, lowering of the expanded tool 10 into the casing C will cause the downhole ends 30 of one or more of the guide fingers 18 to wedge between the casing C and the uphole end of the fish F. Continued lowering of the tool 10 will cause the frustoconical guide cage formed by the fingers 18 to guide the fish F through the finger cage 20, until the fish F is securely wedged into the collet 32 by the spear 34, as seen in FIG. 7. Alternatively, any other type of latch mechanism may be employed, rather than the collet and spear combination.

As shown in FIG. 7, the fish F is sufficiently engaged so that it can be pulled from the hole. This forcing of the collet 32 downwardly over the fish F pushes the collet 32 upwardly relative to the mandrel 19, against the downward force exerted on the collet 32 by the wave spring 42. When the collet 32 has been pushed upwardly a sufficient distance to uncover the tell-tale hole 40, a fluid pressure drop is seen by the operator, providing positive indication that the fish F has been latched to the tool 10. The operator can then pull the fish F and the tool 10 from the hole.

When the fish F is latched, a shoulder on the fish F is captured by one or more shoulders on the interior of the collet 32, to securely engage the fish F to the collet 32. During pulling, the weight of the fish F pulls the collet 32 downwardly to abut the upper end of the finger cage 20, and the weight of the fish F is borne by the mandrel 19, the mandrel skirt 21, the finger cage 20, and the collet 32. One or more of the fingers 18 may become free to rotate slightly in its respective sleeve slot 46 during pulling, depending upon the angle between the fish F and the tool 10, and depending upon the relative position of the finger sleeve 16. Further, fluid pressure may be dropped by the operator during pulling, allowing the piston 14 and the sleeve 16 to be shifted downwardly by the spring 22, thereby allowing one or more of the fingers 18 to pivot toward its retracted position. The degree to which any of the fingers 18 retract may be determined by the degree of interference, if any, between the fish F, and the fingers 18.

Figure 8:
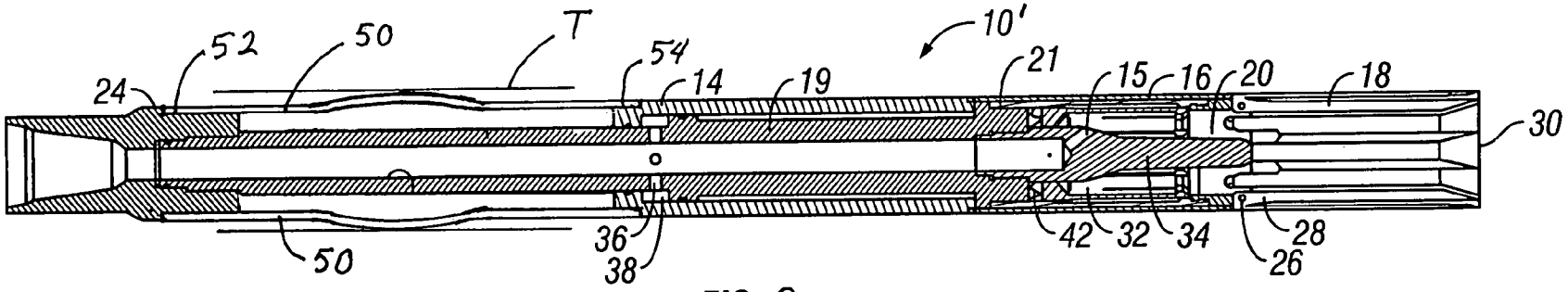
FIG. 8 is a longitudinal section view of a tool having a mechanical actuation mechanism, in the running configuration.
Figure 9:
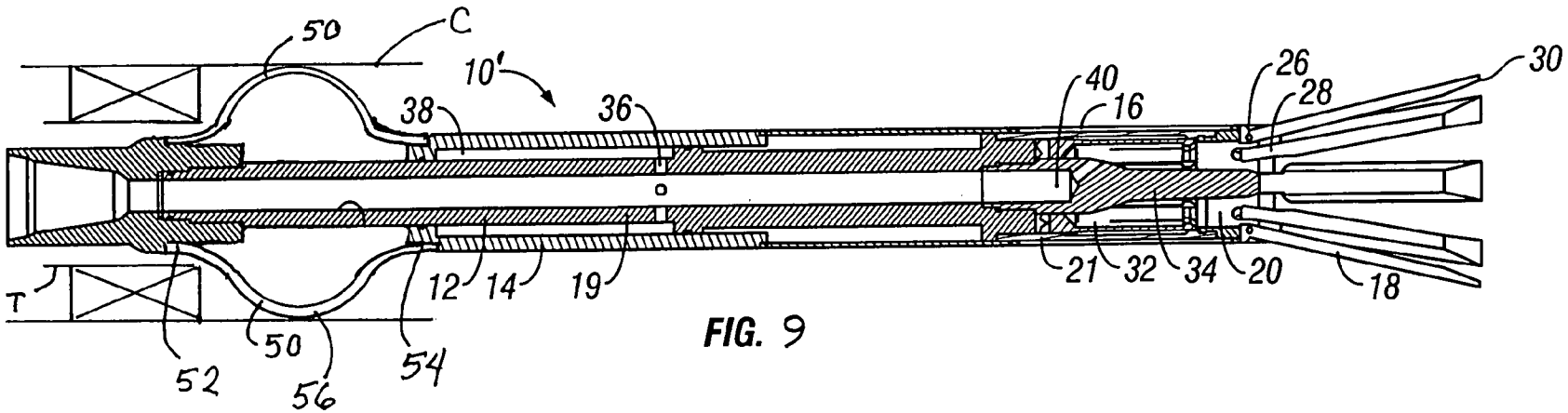
FIG. 9 is a longitudinal section view of the tool shown in FIG. 8, with the guide fingers in the expanded configuration.

In accordance with the present invention, a second embodiment of the tool 10' is shown in FIGS. 8 and 9. As shown in FIGS. 8 and 9, the fishing tool 10' includes a mandrel assembly 12, a finger sleeve 16 longitudinally movable relative to the mandrel assembly 12, a bow spring 50 attaching the finger sleeve 16 to the mandrel assembly 12, and a plurality of guide fingers 18 pivotably attached to the downhole end of the mandrel assembly 12. The approximate center 56 of the bow spring 50 is biased outwardly. A hollow piston 14 and the actuation ports 36 can also be provided in this embodiment, with the bow spring 50 attached to the finger sleeve 16 by means of the piston 14. Alternatively, the piston 14 and the actuation ports 36 could be omitted, and the bow spring 50 could be attached directly to the finger sleeve 16. Inclusion of the piston 14 and the actuation ports 36 in this embodiment enables the tool 10' to function either hydraulically or mechanically, as appropriate for any given application. The hydraulic operation would be as explained above, while the mechanical operation would be as explained below.

In FIG. 8, the finger sleeve 16 is shown in its downhole position relative to the mandrel assembly 12. In FIG. 9, the finger sleeve 16 is shown in its uphole position relative to the mandrel assembly 12. The upper end 52 of the bow spring 50 is attached indirectly to the mandrel 19 by being attached directly to the top sub 24, and the lower end 54 of the bow spring 50 is attached, either directly or indirectly, to the finger sleeve 16. The top sub 24 is adapted to attach to a work string (not shown), which can be either a tubular element or a wire line.

FIG. 8 shows the tool 10' in the running configuration, with the free downhole ends 30 of the guide fingers 18 pivoted radially inwardly to their retracted positions. In this configuration, a tubular element T having an inner diameter smaller than the diameter of the casing C constrains the approximate center 56 of the bow spring 50 inwardly, to force the lower end 54 of the bow spring 50 to be extended longitudinally downwardly relative to the mandrel 19. The tubular element T can be a smaller section of casing, a casing liner, or even a part of the work string, as appropriate for a given application. This forcing of the lower end 54 of the bow spring 50 downwardly exerts sufficient force to hold the finger sleeve 16 in its downhole position. It can be seen that the finger sleeve 16 contacts the outer edges or surfaces of the fingers 18 to hold their free downhole ends 30 inwardly. FIG. 3 shows an elevation view of the downhole end of the tool 10' in this running configuration.

FIG. 9 shows the tool 10' with the free downhole ends 30 of its guide fingers 18 in their fully expanded positions. FIG. 4 shows an elevation view of the downhole end of the tool 10' in this expanded configuration. As shown here, the downhole ends 30 of the guide fingers 18 are expanded by a radial distance which is designed to contact the wall of a given diameter bore hole or casing, as in FIG. 6.

When the tool 10' has been lowered into the bore hole in the running configuration shown in FIGS. 8 and 3, to a position just above a fish, the tool 10' is shifted into its expanded configuration as in FIGS. 9 and 4 through 7. To shift the tool 10' from the running configuration to the expanded configuration, as the bow spring 50 exits the smaller diameter tubular T into the larger diameter casing C, the outward bias of the bow spring 50 causes its approximate center 56 to expand radially outwardly. This expansion of the bow spring 50 draws the lower end 54 of the bow spring 50 upwardly relative to the mandrel 19. This causes the finger sleeve 16 to shift longitudinally in the uphole direction relative to the mandrel 19, placing the finger sleeve 16 in its uphole position relative to the mandrel assembly 12, thereby expanding the guide fingers 18 as explained above, enabling the guiding of the fish F into the latch mechanism. The operator can then pull the fish F and the tool 10' from the hole.

When the fish F is latched, as explained above, a shoulder on the fish F is captured by one or more shoulders on the interior of the collet 32, to securely engage the fish F to the collet 32. During pulling, the weight of the fish F pulls the collet 32 downwardly to abut the upper end of the finger cage 20, and the weight of the fish F is borne by the mandrel 19, the mandrel skirt 21, the finger cage 20, and the collet 32. One or more of the fingers 18 may become free to rotate slightly in its respective sleeve slot 46 during pulling, depending upon the angle between the fish F and the tool 10', and depending upon the relative position of the finger sleeve 16. Further, as the tool 10' withdraws into the tubular element T during pulling, the bow spring 50 is forced back to its smaller diameter constrained condition, forcing the lower end 54 of the bow spring 50 downwardly, causing the sleeve 16 to be shifted downwardly, thereby allowing one or more of the fingers 18 to pivot toward its retracted position. The degree to which any of the fingers 18 retract may be determined by the degree of interference, if any, between the fish F, and the fingers 18.

It can be seen that the fingers 18 can be either mechanically expanded or mechanically retracted, or both, by the action of the bow spring 50 as it interacts with the smaller diameter tubular element T. Further, it can be seen that, where both the bow spring 50 and the piston 14 are included in the tool 10', expansion of the fingers 18 can be hydraulically accomplished or assisted. In an application where hydraulic actuation is planned, the bow spring 50 can be constrained to its retracted condition during run-in, for example, by restraining the piston 14 in its lower position by means such as a shear pin (not shown). Hydraulic actuation of the tool 10' will then shear the pin, and thereafter the tool 10' functions as explained above. In an application where mechanical actuation is planned, removal of the shear pin before running the tool 10' downhole allows mechanical actuation of the tool 10' by means of the action of the bow spring 50, as the tool 10' exits the tubular element T.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A fishing tool guiding mechanism, comprising:

a mandrel assembly adapted to attach to a work string for lowering into a well bore or casing;

a plurality of elongate fingers, each said finger having an uphole end pivotably attached to a downhole end of said mandrel assembly, each said finger having a free downhole end;

a sleeve mounted for movement between uphole and downhole positions relative to said mandrel assembly, said sleeve being adapted to forcibly pivot said downhole ends of said plurality of fingers radially outwardly a sufficient distance to forcibly contact an inner surface of a well bore or casing, when said sleeve is in one of its said downhole position and its said uphole position; and an actuation mechanism mounted to said mandrel assembly, said actuation mechanism being adapted to move said sleeve between said uphole position and said downhole position relative to said mandrel assembly.

2. The guiding mechanism recited in claim 1, further comprising:

a plurality of longitudinal slots in said sleeve; and a tang extending radially from each said finger into one of said sleeve slots;

wherein each said tang is oriented to be forced in one of the uphole and the downhole directions by one end of its respective sleeve slot, when said sleeve is in one of its said uphole position and its said downhole position, thereby forcibly pivoting said downhole end of its respective said finger radially outwardly to forcibly contact the well bore or casing.

3. The guiding mechanism recited in claim 2, wherein:

each said tang extends radially outwardly from its respective said finger; and said sleeve is positioned radially outwardly from said tangs, thereby positioning said lower ends of said sleeve slots to force said tangs in said uphole direction to forcibly pivot said downhole ends of said fingers radially outwardly when said sleeve is in its said uphole position.

4. The guiding mechanism recited in claim 3, wherein said sleeve is configured to at least partially surround said plurality of fingers when said sleeve is in its said downhole position.

5. The guiding mechanism recited in claim 4, wherein said sleeve contacts radially outward edges of said plurality of fingers to forcibly pivot said downhole ends of said plurality of fingers radially inwardly when said sleeve is in its said downhole position.

6. The guiding mechanism recited in claim 1, further comprising a spring positioned to bias said sleeve in one of said uphole and downhole directions.

7. The guiding mechanism recited in claim 1, wherein said mandrel assembly comprises:

a mandrel;

a finger cage attached to a lower end of said mandrel; and a plurality of pivot points on said finger cage, each said uphole end of each said finger being pivotably attached to one of said pivot points.

8. The guiding mechanism recited in claim 1, wherein:

said actuation mechanism comprises a bow spring biased outwardly;

a first end of said bow spring is fixedly attached relative to said mandrel assembly; and a second end of said bow spring is attached to said sleeve.

9. The guiding mechanism recited in claim 8, wherein:

an upper end of said bow spring is fixedly attached relative to said mandrel assembly;

a lower end of said bow spring is attached to said sleeve;

outward flexing of said bow spring pulls said sleeve in said uphole direction; and inward flexing of said bow spring pushes said sleeve in said downhole direction.

10. The guiding mechanism recited in claim 1, wherein said sleeve is adapted to forcibly pivot said downhole ends of said plurality of fingers radially outwardly when said sleeve is in its said uphole position.

11. The guiding mechanism recited in claim 1, wherein said sleeve is adapted to forcibly pivot said downhole ends of said plurality of fingers radially inwardly when said sleeve is in the other of its said downhole position and its said uphole position.

12. The guiding mechanism recited in claim 11, wherein said sleeve is adapted to forcibly pivot said downhole ends of said plurality of fingers radially inwardly when said sleeve is in its said downhole position.

13. A method for retrieving a fish from a well bore or casing, comprising:

providing a fishing tool attached to a work string, said fishing tool having a mandrel assembly, a latch mechanism, an actuation mechanism, and a plurality of elongate fingers pivotably attached to a lower end of said mandrel assembly;

lowering said fishing tool into a well bore or casing;

forcibly pivoting the downhole ends of said plurality of fingers radially outwardly, to forcibly contact the well bore or casing;

further lowering said fishing tool into the well bore or casing until said fingers surround a fish and guide the fish into contact with said latch mechanism;

latching the fish to said fishing tool with said latch mechanism; and pulling said fishing tool and the fish from the well bore or casing.

14. The method recited in claim 13, further comprising pivoting said downhole ends of said plurality of fingers radially inwardly after latching the fish with said latch mechanism.

15. The method recited in claim 13, further comprising:

providing a sleeve mounted for longitudinal movement relative to said mandrel assembly;

providing a bow spring on said mandrel assembly; and applying force with said bow spring, thereby moving said sleeve to forcibly pivot said downhole ends of said plurality of fingers radially outwardly by contact with said sleeve.

16. The method recited in claim 15, further comprising:

providing a sleeve mounted for longitudinal movement relative to said mandrel assembly;

providing a bow spring on said mandrel assembly; and applying force with said bow spring, thereby moving said sleeve to forcibly pivot said downhole ends of said plurality of fingers radially inwardly after latching the fish with said latch mechanism.

* * * * *